US009515408B2

(12) United States Patent
Annis et al.

(10) Patent No.: US 9,515,408 B2
(45) Date of Patent: Dec. 6, 2016

(54) LATCH ASSEMBLIES FOR CONNECTOR SYSTEMS

(71) Applicant: Tyco Electronics Corporation, Berwyn, PA (US)

(72) Inventors: Kyle Gary Annis, Hummelstown, PA (US); Kevin Michael Thackston, York, PA (US); Matthew Richard McAlonis, Elizabethtown, PA (US); Albert Tsang, Harrisburg, PA (US); Mitchell Kunane Storry, Harrisburg, PA (US); Nicholas Paul Ruffini, York, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/709,102

(22) Filed: May 11, 2015

(65) Prior Publication Data

US 2015/0333439 A1 Nov. 19, 2015

Related U.S. Application Data

(60) Provisional application No. 61/996,783, filed on May 14, 2014.

(51) Int. Cl.
*H01R 13/436* (2006.01)
*H01R 13/62* (2006.01)
(Continued)

(52) U.S. Cl.
CPC ..... *H01R 13/4361* (2013.01); *H01R 13/62* (2013.01); *H01R 13/62911* (2013.01); *H01R 13/635* (2013.01)

(58) Field of Classification Search
CPC .... H01R 43/26; H01R 13/436; H01R 13/4361
See application file for complete search history.

(56) References Cited

U.S. PATENT DOCUMENTS 5,201,674 A * 4/1993 Okura ..... H01R 13/4361 439/594
5,871,363 A 2/1999 Kimura
(Continued)

FOREIGN PATENT DOCUMENTS

DE 197 21 444 A1 12/1997
DE 198 37 896 A1 2/2000
(Continued)

OTHER PUBLICATIONS

European Search Report, Mail Date Oct. 15, 2015, EP 15 16 7735, Application No. 1567735.8-1801.

*Primary Examiner* — James Harvey

(57) ABSTRACT

A connector system includes a cartridge having a cavity configured to hold one or more connector modules therein. The cartridge has a port opening to the cavity. The cartridge receiving the one or more connector modules through the port. The connector system includes a release mechanism housed in the cavity. The release mechanism configured to eject the one or more connector modules when actuated. The connector system includes a release button exposed beyond the cartridge and operably coupled to the release mechanism. The release button being pressed to an actuated position to activate the release mechanism. The release button is configured to be in a locked position to avoid inadvertent activation thereof.

20 Claims, 10 Drawing Sheets

(51) Int. Cl.
*H01R 13/629* (2006.01)
*H01R 13/635* (2006.01)

(56) References Cited

U.S. PATENT DOCUMENTS 6,036,509 A 3/2000 Maejima
6,358,088 B1 * 3/2002 Nishio ..... H01R 13/436 439/595
7,128,618 B1 * 10/2006 Roberts ..... G01R 31/045 439/700
2005/0020114 A1 1/2005 Denter et al.
2010/0190367 A1 * 7/2010 Abe ..... H01R 43/26 439/153
2011/0260745 A1 10/2011 Naitou
2013/0337671 A1 * 12/2013 Tsang ..... H01R 13/6275 439/159
2014/0170894 A1 * 6/2014 McCulley ..... H01R 13/4361 439/372
2015/0333439 A1 * 11/2015 Annis ..... H01R 13/62911 439/368
2015/0333441 A1 * 11/2015 Annis ..... H01R 13/62911 439/133
2015/0333443 A1 * 11/2015 Annis ..... H01R 13/641 439/157

FOREIGN PATENT DOCUMENTS

DE 10 2011 005508 A1 9/2012
EP 0 549 371 A2 6/1993
EP 0 655 799 A1 5/1995
EP 0 713 270 A2 5/1996
EP 0 984 524 A2 3/2000
FR 2 860 650 A1 4/2005
GB 2 318 925 A 5/1998
JP H10 41007 A 2/1998
JP 2006 331991 A 12/2006
WO 2006/087097 A1 8/2006

* cited by examiner

LATCH ASSEMBLIES FOR CONNECTOR SYSTEMS

CROSS REFERENCE TO RELATED APPLICATIONS

This application claims the benefit of U.S. Provisional Application No. 61/996,783 filed May 14, 2014 of the same title, the subject matter of which is herein incorporated by reference in its entirety.

BACKGROUND OF THE INVENTION

The subject matter herein relates generally to latch assemblies for connector systems.

Connector systems typically include electrical connectors and mating electrical connectors configured to be mated with corresponding electrical connectors. In some applications, the electrical connectors are part of a backplane. The electrical connectors are coupled to the backplane and positioned for mating with the mating electrical connectors. The electrical connectors may be mounted to the backplane.

Current retention methods include designs with screws that secure the electrical connectors to the backplane. Such retention methods require tools to assemble and unassembled, which is time consuming. Also, loosening of the screws due to vibration is another potential problem. Other retention methods include mechanisms to quickly release the electrical connectors. Such retention mechanisms are prone to being inadvertently released.

A need remains for a mechanism to retain an electrical connector to a surface in such a way to create a simple interface. A need remains for a tool-less means of attaching electrical connectors to a backplane that provides a lockable release mechanism.

BRIEF DESCRIPTION OF THE INVENTION

In one embodiment, a connector system is provided including a cartridge having a cavity configured to hold one or more connector modules therein. The cartridge has a port opening to the cavity. The cartridge receiving the one or more connector modules through the port. The connector system includes a release mechanism housed in the cavity. The release mechanism configured to eject the one or more connector modules when actuated. The connector system includes a release button exposed beyond the cartridge and operably coupled to the release mechanism. The release button being pressed to an actuated position to activate the release mechanism. The release button is configured to be in a locked position to avoid inadvertent activation thereof.

In another embodiment, a connector system is provided including a cartridge having a cavity configured to hold one or more connector modules therein. The cartridge has a port opening to the cavity. The cartridge receiving the one or more connector modules through the port. The connector system includes a release mechanism housed in the cavity. The release mechanism is configured to eject the one or more connector modules when actuated. The connector system includes a release button exposed beyond the cartridge and operably coupled to the release mechanism. The release button being pressed to activate the release mechanism. The release button configured to be in a locked position to avoid inadvertent activation thereof. The release button includes a button base movably coupled to the release mechanism. The release button also includes a button top rotatably engaging the button base. The button top rotatable between an unlocked and locked position.

DETAILED DESCRIPTION OF THE INVENTION

Figure 1:
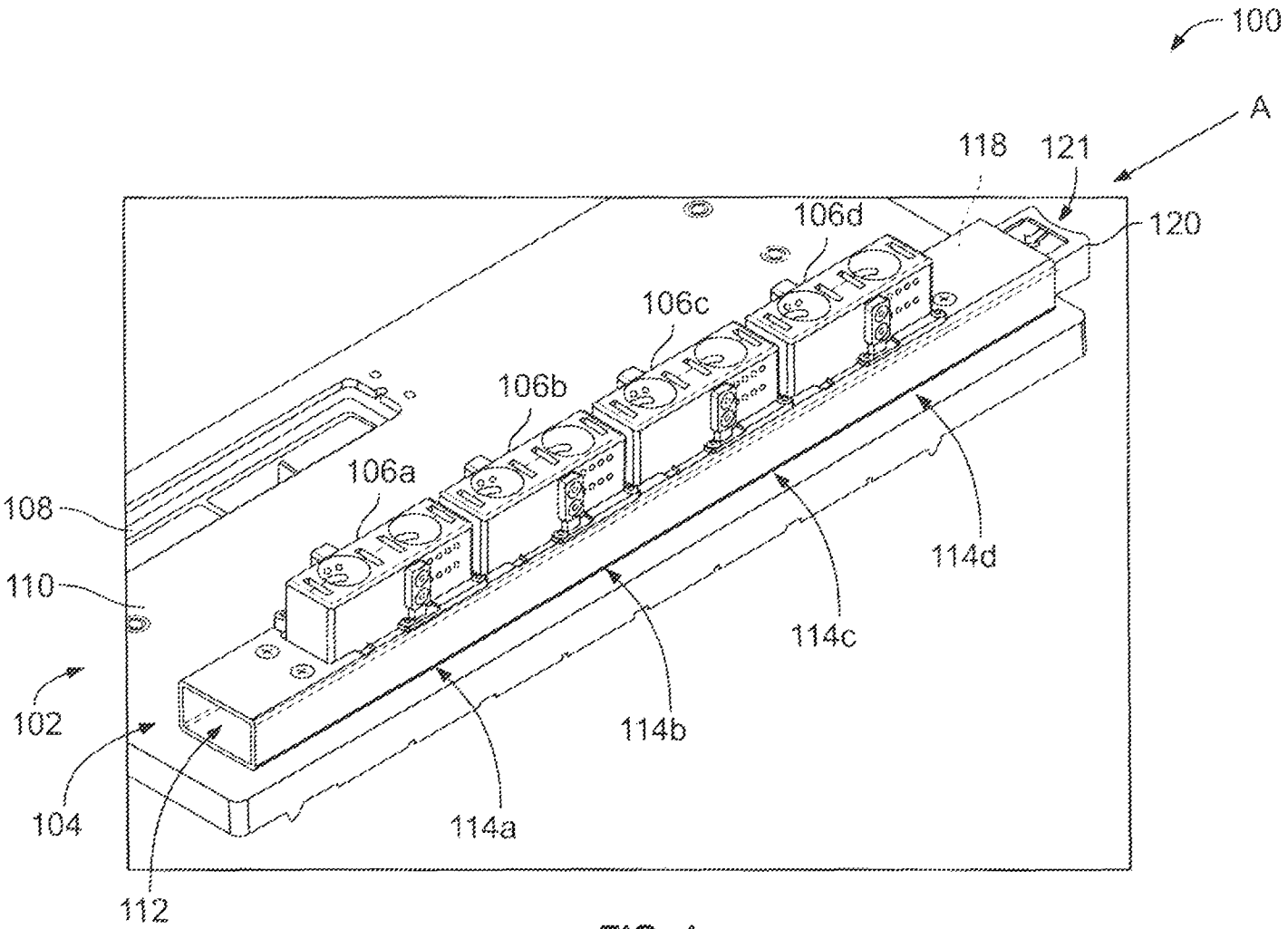
FIG. 1 is a perspective view of a connector system formed in accordance with an embodiment.

FIG. 1 is a perspective view of a connector system 100 formed in accordance with an exemplary embodiment. The connector system 100 includes a backplane assembly 102 having a cartridge 104 mounted thereto. The cartridge 104 is configured to hold at least one connector module 106 therein. The connector modules 106 may be configured to be electrically connected to corresponding mating electrical connectors (not shown) in the backplane assembly 102 as part of a network system, a server, or other type of system. For example, the mating electrical connectors may be part of a daughter card (not shown) or a backplane printed circuit board (PCB) 108 that is made into the backplane assembly 102.

The cartridge 104 is coupled to the backplane assembly 102 and is used to couple the connector modules 106 to the backplane assembly 102. The cartridge 104 may be coupled to the backplane assembly 102 using fasteners that extend into and/or through openings in the backplane assembly 102. The backplane assembly 102 may include a stiffener 110 between the backplane PCB 108 and the cartridge 104 to structurally support the cartridge 104.

The connector modules 106 may be any type of connectors. The connector modules 106 may include a plurality of contacts or terminals that are configured to be mated to corresponding contacts or terminals of the mating electrical connectors. The contacts or terminals may be terminated directly to the backplane PCB 108 or the daughter card of the backplane assembly 102, such as by surface mounting or through hole mounting to the backplane assembly 102. Alternatively, the contacts or terminals may be terminated to ends of wires of the cables of the cable mounted electrical connectors. The contacts of terminals may be any types of contacts or terminals, such as pins, sockets, blades, tuning forks, plugs, receptacles, and the like. The electrical connectors may be fiber optic connectors in alternative embodiments.

The cartridge 104 includes at least one cavity 112 configured to hold the connector modules 106 therein. The cavity 112 includes at least one port 114 sized and shaped to receive one of the connector modules 106. The at least one port 114 is open to backplane assembly 102 such that the connector modules 106 travel to and through the port 114 to be received in the backplane assembly 102. In the illustrated embodiment, the cavity 112 has four ports 114*a*, 114*b*, 114*c*, and 114*d*, each holding a corresponding connector module 106*a*, 106*b*, 106*c*, and 106*d* therein. In other embodiments, the cavity 112 may include more or fewer ports 114.

In an exemplary embodiment, the connector system 100 includes a slider latch 116 (shown in FIG. 2) coupled to the connector modules 106 to couple the connector modules 106 to the cartridge 104. The connector system 100 also includes a release mechanism 118 (also shown in FIG. 2) configured to release or eject the connector modules 106 form the cartridge 104 when the release mechanism 118 is actuated. The release mechanism 118 is housed within the cavity 112. The release mechanism 118 is operably coupled to the slider latch 116 to release the connector module 106 from the slider latch 116 to eject or disengage the connector module 106 from the cartridge 104.

A release button 120 is operably coupled to the release mechanism 118 such that the release mechanism 118 is activated when the release button 120 is pressed. The release button 120 may include a generally concave portion 121 allowing a finger to engage the release button 120. In an exemplary embodiment, the release mechanism 118 extends beyond the cartridge 104 to make the release button 120 easily accessible. The release button 120 is actuated when the release button 120 is pressed in a direction indicated by the arrow A. The release button 120 allows for quick disconnection of the connector modules 104 from the backplane assembly 102. For example, the release mechanism 118 may concurrently disengage or eject one or more of the connector modules 106 held in each of the ports 114. In an exemplary embodiment, the release button 120 is configured to be lockable to avoid inadvertent activation of the release mechanism.

Figure 2:
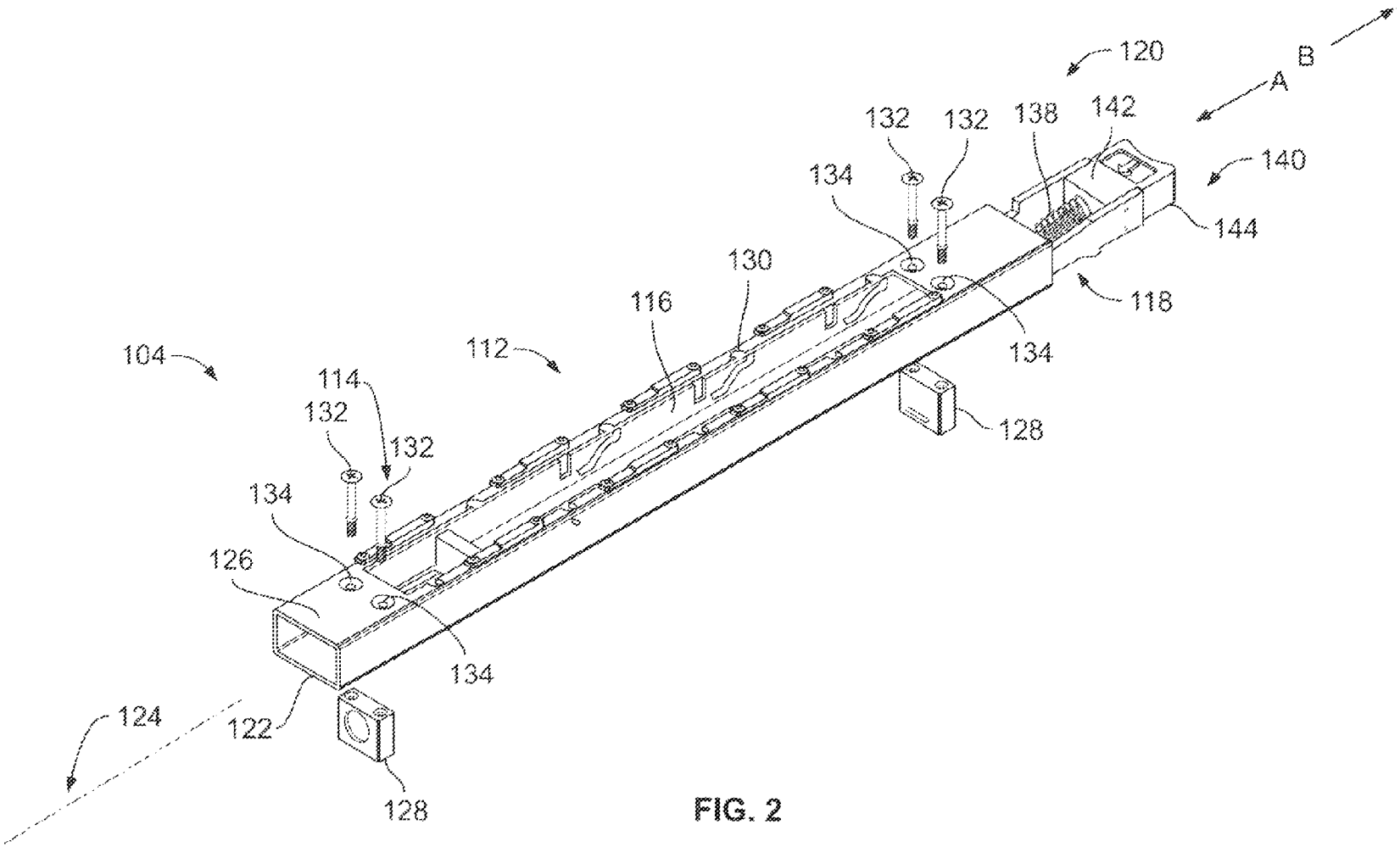
FIG. 2 is an exploded perspective view of a cartridge formed in accordance with an embodiment.

FIG. 2 is an exploded perspective view of the cartridge 104. The cartridge 104 includes a base frame 122. The base frame 122 defines the cavity 112 therein. The base frame 122 may be generally U-shaped in cross-section and extend along a longitudinal axis 124. In other embodiments, other shapes are possible.

The base frame 122 includes an alignment surface 126. The alignment surface 126 is part of the base frame 122. The connector modules 106 (shown in FIG. 1) are configured to be loaded into the cartridge 104 through the ports 114. The alignment surface 126 provides access to the slides latches 116 through the ports 114. The slider latches 116 have profiled grooves 130 configured to latachably receive a key (not shown) on the connector modules 106 to secure the connector module 106 to the cartridge 104.

One or more cartridge spacers 128 may be used to provide support for the slider latches 116 and/or the release mechanism 118 within the cavity 112. Threaded fasteners 132 extends to and through holes 134 in the alignment surface 126 and are received by cartridge spacers 136 held within the cavity 112. The threaded fasteners 132 join the base frame 122 to the backplane assembly 102. The base frame 122 may have a generally rectangular cross section.

When actuated, the release mechanism 118 causes the connector modules 106 to be ejected or released from the cartridge 104. In an exemplary embodiment, the key on the connector module 106 is released from the profiled grooves 130 when the release mechanism 118 is actuated. The key may be used to guide mating. The release mechanism 118 is actuated by moving the release mechanism 118 in the direction A. The release mechanism 118 is operably coupled to the release button 120 to move the along the longitudinal axis 124. For example, the release mechanism 118 may include fasteners (not shown) inserted to and through opposite sides of the release button 120. A return spring 138 is positioned between the release button 120 and one of the cartridge spacers 136. The return spring 138 applies a bias force in the direction B on the release mechanism 118 to return to release mechanism 118 to a resting or deactivated position. In this manner the release button 120 is operably coupled to the release mechanism 118 to eject the connector module 106 from the cartridge 104.

The release button 120 has an interface end 140. The release button 120 includes a button base 142 and a button top 144. The button base 142 is coupled to the release mechanism 118. The button base 142 is positioned within the cavity 112. The release button 120 is exposed beyond the base frame 122 of the cartridge 104. The button top 144 is positioned at the interface end 140. The button top 140 provides an interface for an operator to actuate the release mechanism 118. The release button 120 may include discrete components that are joined to one another as discussed below.

The release button 120 is configured to be switchable between a locked and unlocked position. The release button 120 is configured to be secured in a locked position such that the release button 120 cannot be depressed to activate the release mechanism 118. The release button 120 may be locked to prevent inadvertent activation. For example, the release button 120 may be locked to prevent severe vibration or shock from momentarily moving the release button 120 to cause the release mechanism 118 to activate. In the unlocked position, the release button 120 may be actuated such that the release button 120 may be pressed to cause the release mechanism 118 to be actuated. In an exemplary embodiment, the release button 120 includes retention features 145 (shown in FIGS. 6, 7, 8, 9 10, 11, and 12) configured to hold the release button 120 in the locked or unlocked position. For example, locking the button 120 prevents the release mechanism 118 from activating by preventing the slider latch 116 from moving into the base frame 122.

Figure 4:
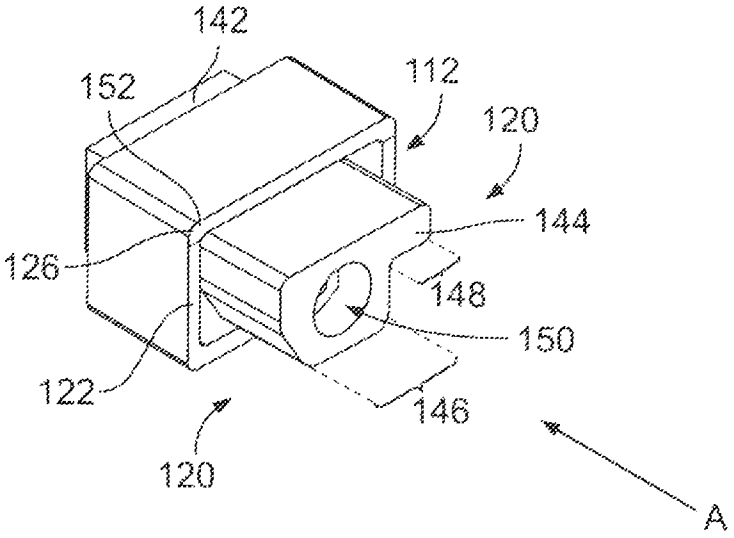
FIG. 4 is a front view of a release button in the unlocked position formed in accordance with an embodiment.
Figure 3:
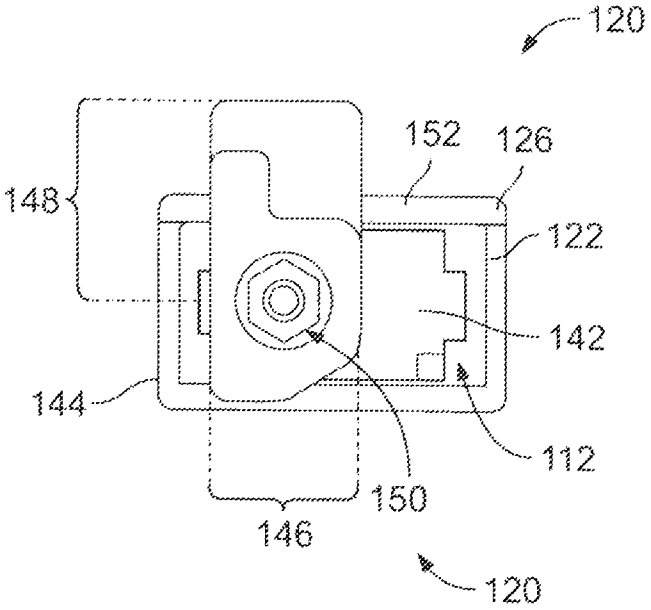
FIG. 3 is a perspective view of a release button in the locked position formed in accordance with an embodiment.

FIG. 3 is a perspective view of the release button 120 in the locked position. FIG. 4 is a front view of the release button 120 in the unlocked position.

The release button 120 is generally rectangular in shape. The release button 120 includes a central portion 146 having a flanged portion 148 extending from one side thereof. The button top 144 is rotatably attached to the button base 142 such that the button top 144 may rotate relative to the button base 142. The button top 144 may rotate while the button base 142 is held within the cavity 112. The button top 144 may rotate between the locked position and the unlocked position. In the illustrated embodiment, the central portion 146 includes a release button assembly 150 joining the button base 142 to the button top 144.

The flanged portion 148 is sized and shaped prevent the release button 120 from being actuated when in the locked position, as shown in FIG. 3. The flanged portion 148 abuts an outer surface 152 of the base frame 122 and/or the alignment surface 126. The flanged portion 148 prevents the release button 120 from moving into the cavity 112 in the direction A (shown in FIG. 4). As such, in the locked position, the flanged portion 148 prevents the release button 120 from being pressed. In the locked position, the flanged portion 148 guards the release button 120 from activating the release mechanism 118 (shown in FIG. 2).

As shown in FIG. 4, in the unlocked position, the button top 144 may be rotated so that the flanged portion 148 does not interfere with, or abut the outer surface 152. When unlocked the button top 144 aligns with the button base 142 such that the flanged portion 148 is generally parallel with the alignment surface 126. Thus, the button top 144 and the button base 142 may be permitted to travel into the cavity 112 in the direction A in the unlocked position.

Figure 5A:
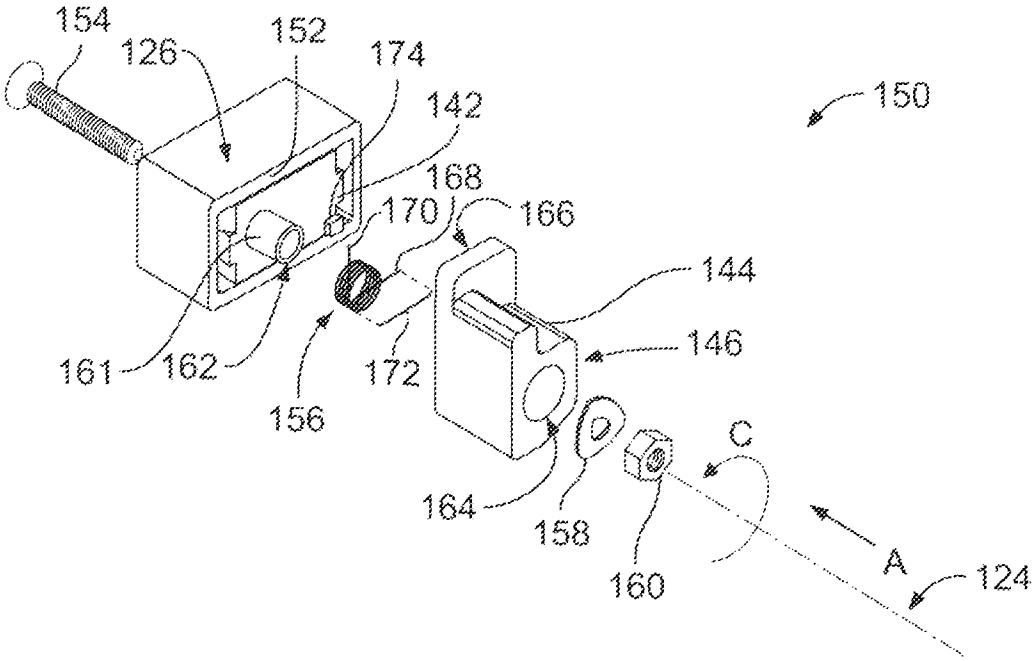
FIG. 5*a* is an exploded perspective view of a release button assembly having a threaded fastener formed in accordance with an embodiment.

FIG. 5*a* is an exploded perspective view of the release button assembly 150 having a threaded fastener 154. The release button assembly 150 is configured to rotatably join the button top 144 with the button base 142. The release button assembly 150 includes the threaded fastener 154, a torsional biasing member 156, a linear biasing member 158, and a threaded receiver 160, among other components.

The threaded fastener 154 extends through the button base 142 and the button top 144. The button base 142 includes cylindrical shaft 161 having a channel 162 extending therethrough. The button top 144 includes a channel 164 extending through the central portion 146. The threaded fastener 154 extends to and through the channel 162, to and through the torsional biasing member 156, to and through the channel 164, and to and through the linear biasing member 158. The threaded fastener 154 is then mated with the threaded receiver 160. The threaded receiver 160 may be tightened to the threaded fastener 154 to join the button base 142 to the button top 144. Additionally or optionally, the threaded fastener 154 may be provided off-axis such that the threaded fastener 132 is not aligned with the longitudinal axis 124. As such, the off-axis arrangement of the threaded fastener 154 may provide greater leverage when twisting the button top 144 than an arrangement in which the threaded fastener 154 is aligned with the longitudinal axis 124.

The torsional biasing member 156 is positioned between the button base 142 and the button top 144. The torsional biasing member 156 may be received in a cavity or recess (not shown) on an inside surface 166 of the button top 144. The torsional biasing member 156 includes a first end 168 and a second end 170 wound upon a body 172. The first end 168 engages a boss 174 on the button base 142. The second end 170 engages the cavity in the button top 144. The torsional biasing member 156 applies a moment on the button top 144 to cause the button top 144 to be bias toward the locked position as indicated by the arrow C.

The linear biasing member 158 is positioned between the button top 144 and the threaded receiver 160. The linear biasing member 158 applies a biasing force on the button top 144 in the direction A. The linear biasing member 158 encourages the button top 144 to abut the outer surface 152 of the alignment surface 126. The linear biasing member 158 may apply the biasing force to allow retention features 145 (shown in FIGS. 6, 7, 8, and 9) to change from the locked position to the unlocked position and vice versa. The linear biasing member 158 may also account for dimensional tolerances in the components. Additionally, the biasing member 158 may apply the biasing force to prevent inadvertent movement of the release button 120 due to shock and/or vibration. In the illustrated embodiment, the linear biasing member 158 is a wave type washer. However, in other embodiments, other linear biasing members 158 may be used, such as, for example, a linear spring. Additionally or optionally, a plurality of linear biasing members 158 may be used to achieve a desired biasing force.

Figure 5B:
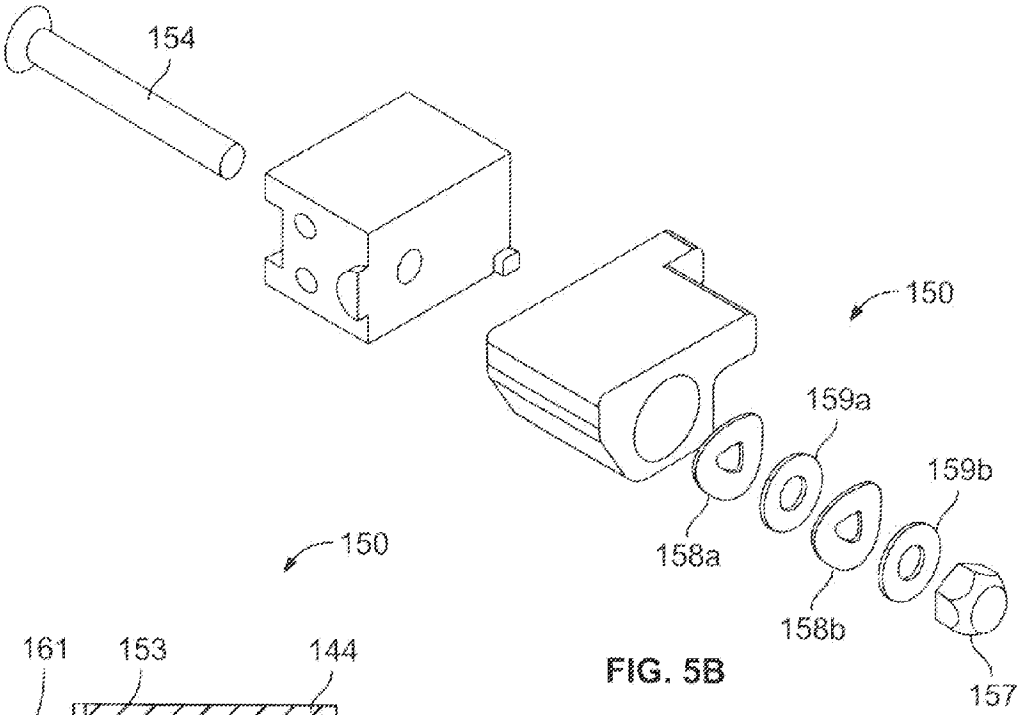
FIG. 5*b* is an exploded perspective view of a release button assembly having a plurality of linear biasing members formed in accordance with an embodiment.

FIG. 5*b* is an exploded perspective view of the release button assembly 150 having a plurality of linear biasing members 158. In the illustrated embodiment, the linear biasing members 158*a* and 158*b* are separated by washers 159*a* and 159*b*. The threaded fastener 154 extends to and through the linear biasing member 158*a*, to and through the washer 159*a*, to and through the linear biasing member 158*b*, to and through the washer 159*b*, and is received by a threaded receiver 157. In the illustrated embodiment, the threaded receiver 157 is a lock type nut, however, in other embodiments, other types of threaded receivers may be used. Accordingly, the release button assembly 150 may include more or fewer linear biasing members 158 to achieve a desired biasing force.

Figure 5C:
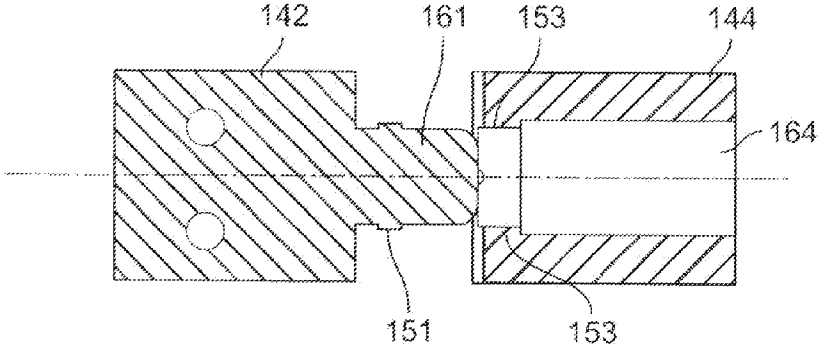
FIG. 5*c* is a cross-sectional view of a release button assembly having a ringed fastener formed in accordance with an embodiment.

FIG. 5*c* is a cross-sectional view of the release button assembly 150 having a ringed fastener 151. In an exemplary embodiment, the ringed fastener 151 circumferentially extends around a portion of the shaft 161 of the button base 142. When the button top 144 is joined with the button base 142, the shaft 161 is received in the channel 164 of the button top 144. The channel 164 includes flanges 153 extending radially inward. The flanges 153 provide a snap fit with the ringed fastener 151. The ringed fastener 151 abuts against flanges 153 to hold the button top 144 against the button base 142 while allowing the button top 144 to rotate.

Figure 7:
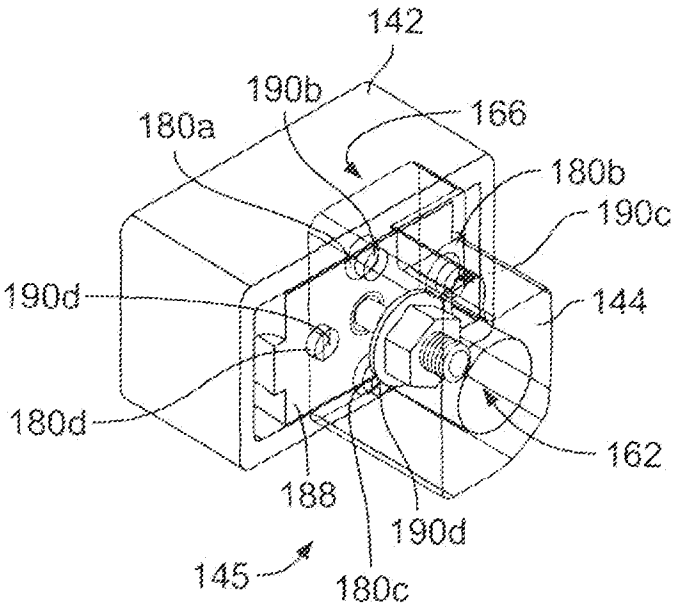
FIG. 7 is a perspective view of a retention feature having bosses holding a release button in the locked position formed in accordance with an embodiment.
Figure 6:
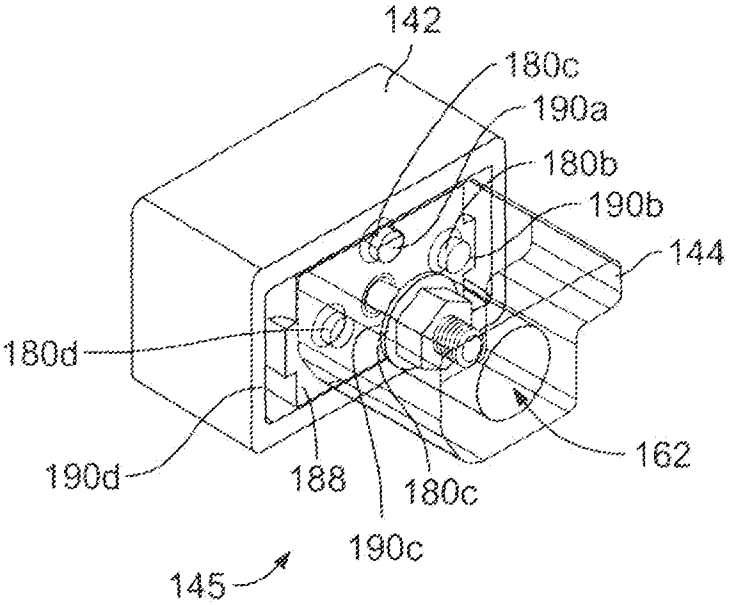
FIG. 6 is a perspective view of a retention feature having bosses holding a release button in the unlocked position formed in accordance with an embodiment.

FIG. 6 is a perspective view of the retention feature 145 having bosses 180 holding the release button 120 in the unlocked position. FIG. 7 is a perspective view of the retention feature 145 having the bosses 180 holding the release button 120 in the locked position.

The button base 142 includes an exposed surface 188 abutting the inside surface 166 of the button top 144. The exposed surface 188 includes bosses 180 selectively distributed on the surface 188. The bosses 180 are configured to engage corresponding depressions or detents 190 on the inside surface 166 of the button top 144. In an exemplary embodiment, the bosses 180 are positioned at 90° intervals radially surrounding the channel 162. The bosses 180 are selectively located around the channel 162 such that the bosses 180 hold the button top 144 in the unlocked position or the locked position when the bosses 180 engage the detents 190. When the button top 144 is in the unlocked position (as shown in FIG. 6), the boss 180*a* engages the detent 190*a*, the boss 180*b* engages the detent 190*b*, the boss 180*c* engages the detent 190*c*, and the boss 180*d* engages the detent 190*d*. When the button top 144 is in the locked position (as shown in FIG. 7), the boss 180*a* engages the detent 190*b*, the boss 180*b* engages the detent 190*c*, the boss 180*c* engages the detent 190*d*, and the boss 180*d* engages the detent 190*a*. In various embodiments, the retention features 145 may include more or fewer bosses 180 and/or detents 190.

Figure 9:
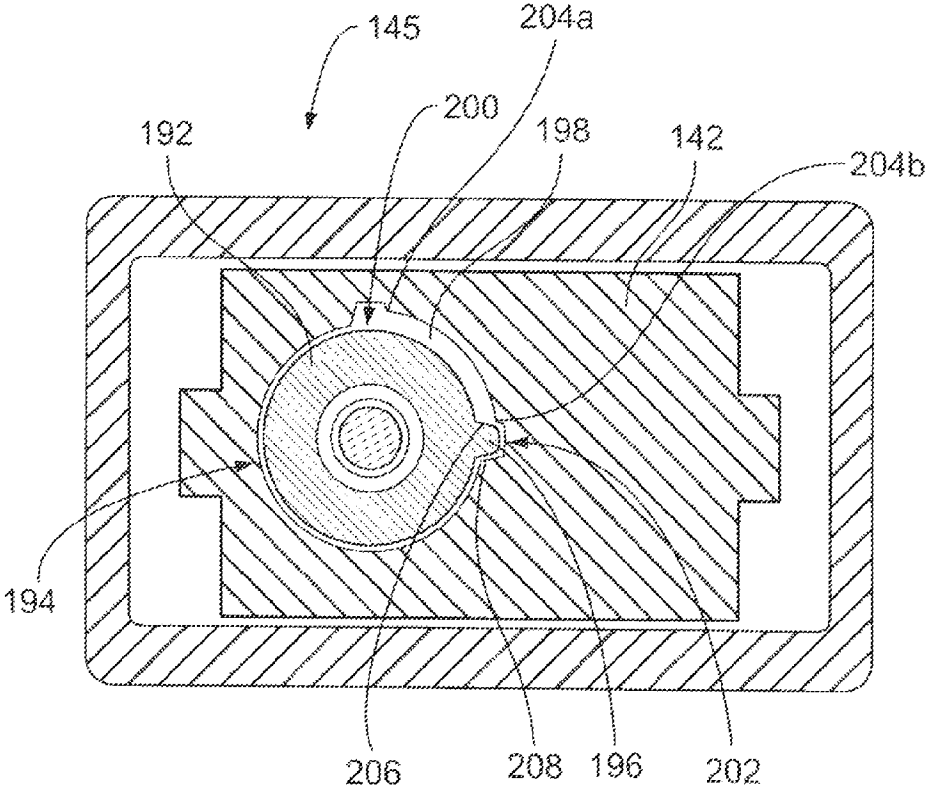
FIG. 9 is a cross-sectional view of a camshaft formed in accordance with an embodiment.
Figure 8:
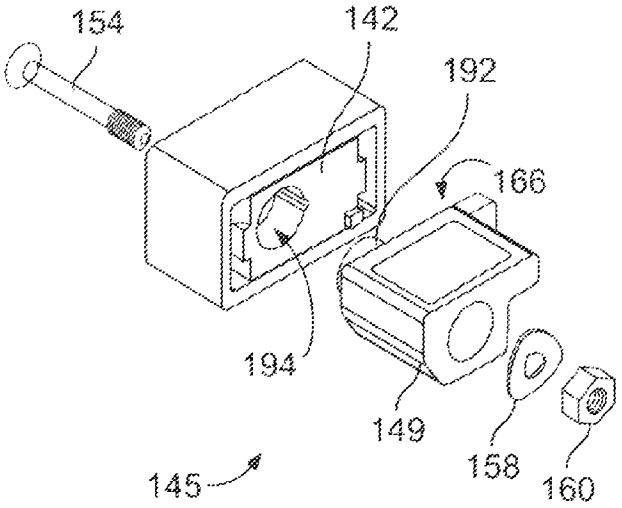
FIG. 8 is an exploded perspective view of a retention feature having a camshaft formed in accordance with an embodiment.

FIG. 8 is an exploded perspective view of the retention feature 145 having a camshaft 192. FIG. 9 is a cross-sectional view of the camshaft 192. The camshaft 192 is configured to hold the button top 144 in the lock and unlock positions. In the illustrated embodiment, the button top 144 includes the camshaft 192 protruding from the inside surface 166. The camshaft 192 is received in a pocket 194 in the button base 142. The threaded fastener 154, linear biasing member 158, and the threaded receiver 160 may hold the button top 144 against the button base 142 as described above in relation to FIG. 5*a* and FIG. 5*b*.

The camshaft 192 includes a cam 196 extending radially outward from a portion thereof. In the illustrated embodiment, the cam 196 has a trapezoidal shape, however in other embodiments, other shapes are possible. The cam 196 travels in a recess 198 in the pocket 194. The recess 198 is sized and shaped to allow the cam 196, and hence the button top 144, to travel between the locked and unlocked position.

The recess 198 includes a lock slot 200 and an unlock slot 202 at ends thereof. The lock slot 200 is selectively located in the pocket 194 such that when the cam 196 is received in the lock slot 200, the button top 144 is in the locked position. The unlock slot 202 is selectively located in the pocket 194 such that when the cam 196 is received in the unlock slot 202, the button top 144 is in the locked position. The lock and unlock slots 200, 202 include inclined surfaces 204*a* and 204*b*, respectively. The inclined surfaces 204 interfere with the cam 196 to encourage the cam 196 to remain in the respective slots 200, 202. For example, a leading edge 206 of the cam 196 strikes the inclined surface 204*b* as the cam 196 is rotated out of the unlock slot 202. A trailing edge 208 strikes the inclined surface 204*a* as the cam 196 is rotated out of the lock slot 200. The cam 196 may be rotated out of the slots 200, 202 with sufficient torque to cause the edges 206, 208 to move along the inclined surface 204 to exit the slots 200, 202.

Figure 11:
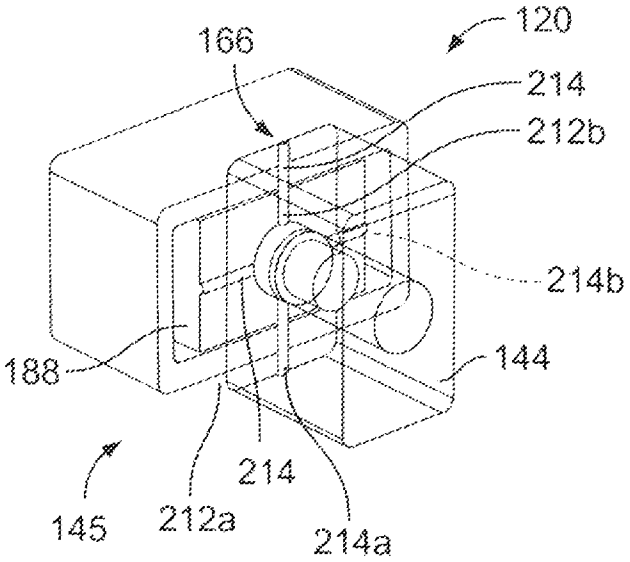
FIG. 11 is a perspective view of a retention feature having ribs holding a release button in the locked position formed in accordance with an embodiment.
Figure 10:
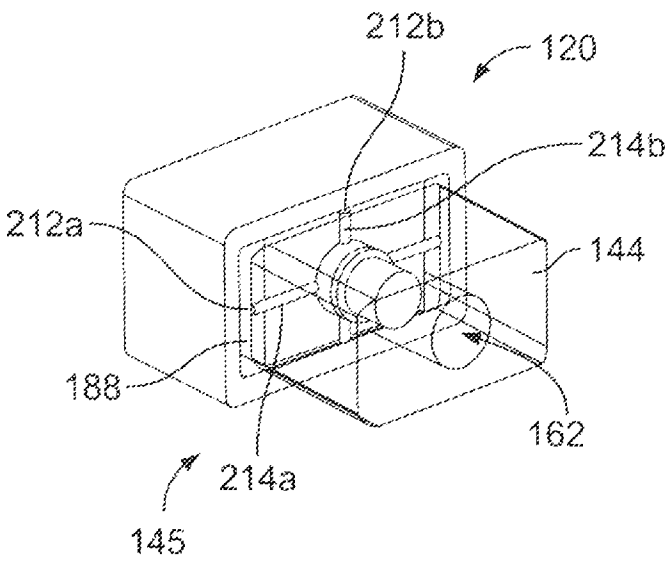
FIG. 10 is a perspective view of a retention feature having ribs holding a release button in the unlocked position formed in accordance with an embodiment.

FIG. 10 is a perspective view of the retention feature 145 having ribs 212 holding the release button 120 in the unlocked position. FIG. 11 is a perspective view of the retention feature 145 having the ribs 212 holding the release button 120 in the locked position.

In an exemplary embodiment, the exposed surface 188 on the button base 142 includes a horizontal rib 212*a* and a vertical rib 212*b*. The ribs 212 extend through the center of the channel 162. In other embodiments, the retention feature 145 may include more or fewer ribs 212. The ribs 212 are configured to engage complementary recess or divots 214 in the inside surface 166 of the button top 144. The divots 214 may be sized and shaped to receive the ribs 212 such that when the ribs 212 engage the divots 214, the inside surface 166 is flush with the exposed surface 188. The ribs 212 and divots 214 may be selectively arranged to hold the button top 144 in the locked position and the unlocked position. When the button top 144 is in the unlocked position, the rib 212*a* engages the divot 214*a*, and the rib 212*b* engages the divot 214*b*. When the button top 144 is in the locked position, the rib 212*a* engages the divot 214*b* and the rib 212*b* engages the divot 214*a*.

Figure 12:
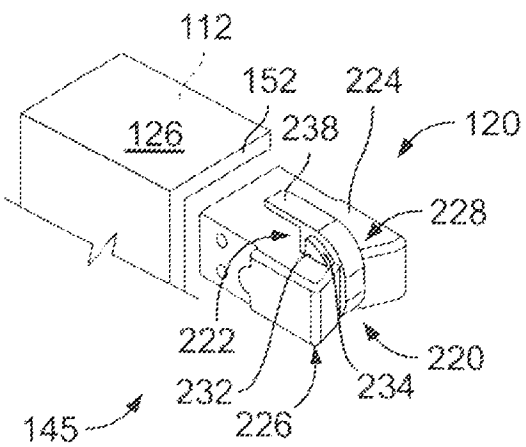
FIG. 12 is a perspective of a retention feature configured to receive a securing member through a passage formed in accordance with an embodiment.

FIG. 12 is a perspective of the retention feature 145 configured to receive a securing member 220 through a passage 222. In the illustrated embodiment, the release button 120 includes the passage 222 extending from a top 224 to a bottom 226. A looped portion 228 of the securing member 220 is passed through the passage 222. The securing member includes a tail portion 230 that terminates to at the top 224. The tail portion 230 abuts the outer surface 152 of the alignment surface 126 to block the release button 120 from entering into the cavity 112. A notch 232 engages an intersection 234 of the looped portion 228 and the tail portion 230. The notch 232 prevents the tail portion 230 from rotating away from the top 224 when the tail portion 230 abuts the outer surface 152.

Figure 13:
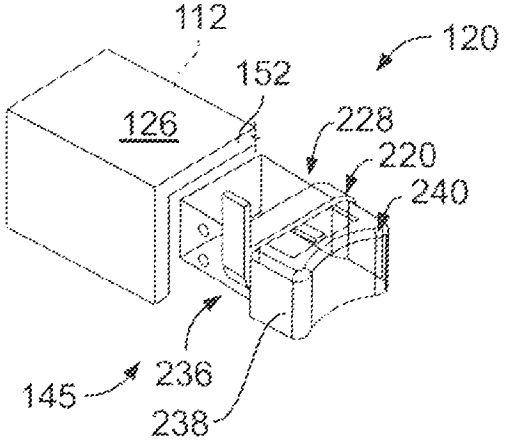
FIG. 13 is a perspective view of a retention feature configured to receive a securing member through a passage extending from opposite sides of a release button formed in accordance with an embodiment.

FIG. 13 is a perspective view of the retention feature 145 configured to receive the securing member 220 through a passage 236 extending from opposite sides 238, 240 of the release button 120. The looped portion 228 of the securing member 220 passes through the passage 236. The securing member 220 abuts the outer surface 152 of the alignment surface 126 to block the release button 120 from entering into the cavity 112.

Figure 14:
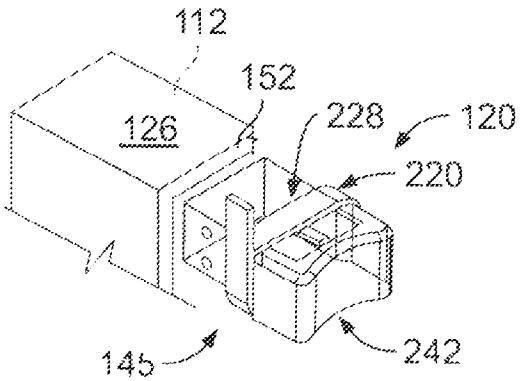
FIG. 14 is a perspective view of a retention feature configured to receive a securing member around a release button formed in accordance with an embodiment.

FIG. 14 is a perspective view of the retention feature 145 configured to receive the securing member 220 around the release button 120. In the illustrated embodiment, the release button 120 does not include the passage 222 (shown in FIG. 12) or the passage 236 (shown in FIG. 13). Instead, the looped portion 228 is wrapped around the body 242 of the release button 120. The looped portion 228 of the securing member 220 abuts the outer surface 152 of the alignment surface 126 to block the release button 120 from entering into the cavity 112.

Figure 15:
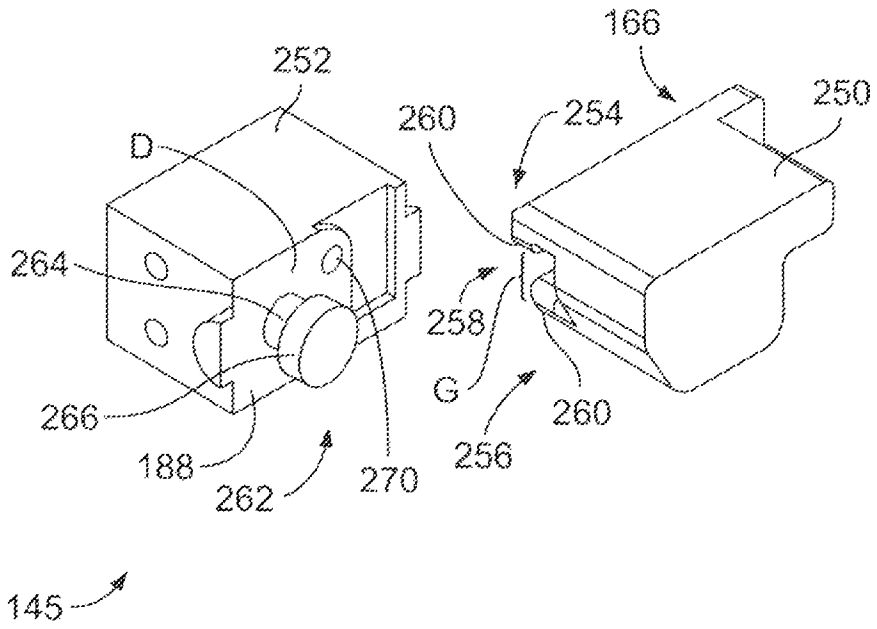
FIG. 15 is a perspective view of a retention feature having a removable button top formed in accordance with an embodiment.

FIG. 15 is a perspective view of the retention feature 145 having a button top 250. In the illustrated embodiment, the button top 250 is removably mounted to a button base 252. The button top 250 is configured to be removed from the button base 252 to prevent the button base 252 from being depressed into the cavity 112 (shown in FIG. 1). However, in other embodiments, the button top 250 may be fixedly attached to the button base 252 such that the button top 250 may not be removed from the button base 252.

The button top 250 includes a cavity 254 open to the inside surface 166. The cavity 254 is proximate to a side 256. The cavity 254 includes a receiving channel 258 open to the side 256. The receiving channel 258 includes mounting shoulders 260 extending therein. The mounting shoulders 260 have define a gap distance G therebetween.

The button base 252 includes a post 262. The post 262 protrudes from the exposed surface 188. The post 262 includes a base portion 264 and a head 266 extending therefrom. The head 266 has a diameter greater than a diameter of the base portion 264.

The post 262 is side loaded into the receiving channel 258 when the button top 250 is coupled to the button base 252. When coupled, the mounting shoulders 260 engage the base portion 264. The base portion 264 may have a diameter D greater than the gap distance G. The mounting shoulders 260 may be complaint such that the mounting shoulders 260 deform to allow the base portion 264 to pass into the receiving channel 258. The mounting shoulders 260 abut against a bottom surface 270 to prevent the button top 250 from moving in the direction B relative to the button base 252. The post 262 is pivotably held within the cavity 254 such that the button top 250 is free to rotate about the post 262.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f) unless and until such claim limitations expressly use the phrase "means for" followed by a statement of function void of further structure.

What is claimed is:

1. A connector system comprising:

a cartridge having a cavity configured to hold one or more connector modules therein, the cartridge having a port open to the cavity, the cartridge receiving the one or more connector modules through the port;

a release mechanism housed in the cavity, the release mechanism configured to eject the one or more connector modules when actuated;

a release button exposed beyond the cartridge and operably coupled to the release mechanism, the release button being pressed to an actuated position to activate the release mechanism;

wherein the release button is positionable in a locked position and is positionable in an unlocked position, the release button being able to be pressed to the actuated position to activate the release mechanism when the release button is in the unlocked position, the release button being unable to be pressed to the actuated position when the release button is in the locked position to avoid inadvertent activation thereof.

2. The connector system of claim 1, wherein the release button further includes a button base and a button top, the button top rotatably attached to the button base.

3. The connector system of claim 1, further comprising a retention feature configured to hold the release button in at least one of the locked position and the unlocked position.

4. The connector system of claim 3, wherein the retention feature includes bosses selectively arranged around a shaft of the release button.

5. The connector system of claim 3, wherein the retention feature includes a cam shaft configured to align the release button with the locked position and the unlocked position.

6. The connector system of claim 3, wherein the retention feature includes ribs configured to engage divots when the release button is in the locked or unlocked position.

7. The connector system of claim 3, wherein the retention feature includes a post, the release button mounted to the post.

8. The connector system of claim 1, further comprising a torsional biasing member configured to apply a moment on the release button to encourage the release button to remain in the locked position.

9. The connector system of claim 1, further comprising a linear biasing member configured to apply a force on the release button to encourage the release button abut the release mechanism.

10. The connector system of claim 1, wherein the release button includes a passage therethrough, the passage configured to receive a securing member, the securing member preventing the release button from being depressed.

11. The connector system of claim 1, wherein the release button is generally rectangular in shape having a flanged portion configured to abut a surface of the cartridge when the release button is in the locked position.

12. A connector system comprising:

a cartridge having a cavity configured to hold one or more connector modules therein, the cartridge having a port open to the cavity, the cartridge receiving the one or more connector modules through the port;

a release mechanism housed in the cavity, the release mechanism configured to eject the one or more connector modules when actuated;

a release button exposed beyond the cartridge and operably coupled to the release mechanism, the release button being pressed to activate the release mechanism; the release button configured to be in a locked position to avoid inadvertent activation thereof, the release button including:

a button base movably coupled to the release mechanism; and a button top rotatably engaging the button base, the button top being rotatable between an unlocked position and the locked position.

13. The connector system of claim 12, wherein the button top is rotatably attached to the button base.

14. The connector system of claim 12, further comprising a release button assembly having a ringed fastener, the ringed fastener providing a snap fit holding the button top to the button base.

15. The connector system of claim 12, wherein the button base further comprises a post, the button top mounted to the post.

16. The connector system of claim 12, further comprising a retention feature configured to hold the release button in the locked position or in the unlocked position.

17. The connector system of claim 16, wherein the retention feature includes bosses selectively arranged around a shaft of the release button.

18. The connector system of claim 16, wherein the retention feature includes a cam shaft configured to align the release button with the locked position and the unlocked position.

19. The connector system of claim 16, wherein the retention feature includes ribs configured to engage divots when the release button is in the locked position or the unlocked position.

20. The connector system of claim 12, wherein the button top is generally rectangular in shape.

* * * * *